United States Patent [19]

Butler

[11] 4,162,209

[45] Jul. 24, 1979

[54] METHOD OF PRODUCING CHAFF

[75] Inventor: Denis V. Butler, Fareham, England

[73] Assignee: Plessey Handel und Investments AG, Zug, Switzerland

[21] Appl. No.: 869,153

[22] Filed: Jan. 13, 1978

[30] Foreign Application Priority Data

Jan. 18, 1977 [GB] United Kingdom ..... 1874/77

[51] Int. Cl.[2] ..... C23C 15/00

[52] U.S. Cl. ..... 204/192 C

[58] Field of Search ..... 204/192 C, 192 R

[56] References Cited

U.S. PATENT DOCUMENTS

| | | | |
|---|---|---|---|
| 3,634,220 | 1/1972 | Goan | 204/192 C |
| 3,660,138 | 5/1972 | Gorrell | 204/192 C |
| 3,801,368 | 4/1972 | Fusayama | 204/192 C |
| 4,009,090 | 2/1977 | Veigel | 204/192 P |

OTHER PUBLICATIONS

Handbook of Thin Film Technology; Leon Maissel and Reinhard Glang, Editors; McGraw-Hill Book Co., New York, 1970, p. 4-2.

*Primary Examiner*—John H. Mack
*Assistant Examiner*—William Leader
*Attorney, Agent, or Firm*—Fleit & Jacobson

[57] ABSTRACT

A method of producing chaff, which method comprises sputtering a coating of a metal on to a plurality of carrier filaments and cutting the coated filaments into small pieces, the metal and the filaments being so chosen that the modulus of elasticity of the metal is not greater than the modulus of elasticity of the filaments.

4 Claims, No Drawings

METHOD OF PRODUCING CHAFF

This invention relates to a method of producing particles for deflecting electromagnetic radiation, e.g. for radio or radar screening purposes. The particles are hereinafter referred to as chaff.

Chaff and its uses are well known. The chaff may be in the form of small pieces of aluminium foil or small pieces of aluminium plated glass filaments. The chaff has for many years been used in electronic countermeasure applications such as where it is necessary to form a radio blanket or to create a false target.

The known aluminium plated glass filament chaff is formed by drawing glass filaments across a meniscus of molten aluminium in a reservoir. The aluminium becomes adhered to the fiber filaments, but mainly to the side of the filaments adjacent the aluminium.

It is an aim of the present invention to provide a new method of producing chaff.

Accordingly, this invention provides a method of producing chaff, which method comprises sputtering a coating of a metal on to a plurality of carrier filaments, and cutting the coated filaments into small pieces, the metal and the filaments being so chosen that the modulus of elasticity of the metal is not greater than the modulus of elasticity of the filaments.

Although the filaments may be coated individually they are preferably wound together in groups, for example in groups of three, prior to the sputtering. After the cutting operation, the cut pieces of filaments are so small that they readily fall apart.

Preferably, the sputtering is effected in the presence of an electrostatic field. This avoids the sprayed metal becoming non-directional and confines the sprayed metal to the vicinity of the filaments. The sputtering can also be effected in a vacuum.

Advantageously, the cutting is effected by milling although other cutter means may be used providing that they can cut the filaments into the required small pieces.

Preferably, the metal used for the coating is aluminium although other metals such for example as silver may be employed.

Preferably, the filaments are glass filaments. Plastic filaments such for example as nylon may also be employed. If desired, the filaments could be made of metal but then this may be difficult to sufficiently finely draw out the filaments.

As indicated above, the metal and the filaments are so chosen that the modulus of elasticity of the metal is not greater than the modulus of elasticity of the filaments since this ensures that when strain is applied to the coated filaments, e.g. during handling, the coating does not break down before the carrier filaments. The modulus of elasticity of the metal can obviously be the same as or less than the modulus of elasticity of the filments.

What we claim is:

1. A method of producing chaff for deflecting electromagnetic radiation, which method comprises the steps of winding a plurality of glass carrier filaments into groups, sputtering a coating of aluminum on to said plurality of carrier filaments in the presence of an electrostatic field of sufficient magnitude to confine said aluminum to the vicinity of said filaments, and cutting the coated filaments into small pieces.

2. A method as claimed in claim 1 in which the winding step comprises winding the filaments together in groups of three prior to the sputtering.

3. A method as claimed in claim 1 in which the sputtering is effected in the presence of a partial vacuum.

4. A method as claimed in claim 1 in which the cutting step comprises milling the coated filaments into small pieces.

* * * * *